United States Patent [19]

Isola

[11] 4,265,042

[45] May 5, 1981

[54] CARTRIDGE RETRIEVER MOUNTING AND ATTACHING DEVICE FOR A COLT M-16 RIFLE

[76] Inventor: Raymond O. Isola, 1071 Killmaster Dr., Oscoda, Mich. 48750

[21] Appl. No.: 118,113

[22] Filed: Feb. 4, 1980

[51] Int. Cl.[3] ..... F41C 27/00
[52] U.S. Cl. ..... 42/1 T
[58] Field of Search ..... 42/1 T; 89/33 F

[56] References Cited

U.S. PATENT DOCUMENTS

| | | | |
|---|---|---|---|
| 2,354,277 | 7/1944 | Richardson | 42/1 T |
| 3,739,685 | 6/1973 | Lundgren | 42/1 T |
| 4,028,834 | 6/1977 | Dobson | 42/1 T |
| 4,204,353 | 5/1980 | Isola | 42/1 T |

*Primary Examiner*—Charles T. Jordan
*Attorney, Agent, or Firm*—Robert L. McKellar

[57] ABSTRACT

What is disclosed is an improved cartridge retriever mounting and attaching device which allows the expedient attachment and removal of a cartridge retriever for use on the Colt M-16 Rifle.

1 Claim, 3 Drawing Figures

CARTRIDGE RETRIEVER MOUNTING AND ATTACHING DEVICE FOR A COLT M-16 RIFLE

BACKGROUND OF THE INVENTION

This invention relates to an improved mounting and attaching device for mounting and attaching a cartridge retriever to a Colt M-16 rifle.

In a earlier patent application U.S. Ser. No. 895,097, now U.S. Pat. No. 4,204,353, in the name of Raymond O. Isola, there was described a cartridge retriever which could be used on shotguns and rifles for retrieving spent cartridges. That device is an improved version over prior art cartridge retrievers and has many novel and new features.

Generally, however, the mounting and locking means described in that application is a simple mounting bar and a projecting, slotted lug, the sides of which are slightly truncated. For most firearms, this mounting means and locking device will suffice and it is convenient.

Such a mounting means, however, cannot fit a Colt M-16 rifle because its configuration would interfere with the atuomatic operation of the rifle.

The inventor herein has invented a novel mounting and locking device especially suited for the M-16 rifle which does not interfere with the operation of the automatic rifle and which allows expeditious mounting and dismounting of the Isola cartridge retriever described in U.S. Ser. No. 895,097. In addition, the mounting and locking device itself is easily mounted and dismounted on the rifle as will be clear from the description hereafter. When in place, the mounting and locking device of this invention holds tightly to the rifle without loosening from the jar of the rifle during operation. In addition, the mounting and locking device of this invention receives and holds tightly the cartridge retriever without fear that the retriever will fall from the weapon.

Thus, the instant invention, although narrow in scope, is a device designed to overcome any disadvantages and shortcomings found in the prior art. It serves as an adjunct to the Isola cartridge retriever when the retriever is in use on the Colt M-16 rifle.

SUMMARY OF THE INVENTION

Accordingly, it is an object of this invention to provide a device which is an improved cartridge retriever mounting and attaching means for expedient attachment and removal of a cartridge retriever for use on the Colt M-16 rifle.

It is a further object to provide a mounting and attachment device which does not interfere with the operation of the M-16 rifle.

It is still a further object to provide a mounting and attachment device which is itself convenient and expeditious to mount and dismount.

It is yet another object of this invention to provide a mounting and attaching device which holds tightly to the rifle housing.

It is a final object of this invention to provide a mounting and attaching device which holds the Isola cartridge retriever tightly to the M-16 rifle.

These objects are accomplished by the present invention by providing a mounting and attaching device which comprises a channelled member that fits over the top of the receiver housing of the Colt M-16rifle such that a lug, with aperture, attached thereto is positioned centrally over the side ejection port of the rifle. The receiver housing with the side ejection port forms no part of this invention. The channelled member has two right angle tabs at its leading end, which is the end located at the forward end of the receiver housing, which serve as securing members when the mounting means is in place and securely locked down. A wedge-shaped locking member fits down over these securing members and is secured by a set screw which is mounted centrally in the front side of the wedge-shaped locking member. The lug attached to the channelled member is located perpendicular to and at the front lower edge of the channelled member. The lug has a slotted hole centrally located therein and is tapered on both side edges to facilitate mounting and removal of a cartridge retriever.

Thus, what has been described is a mounting and attaching device for mounting and attaching a cartridge retriever to an M-16 Colt rifle which comprises in combination a channel member and a wedge-shaped locking device which channel member is a rigid channel member adapted to be mounted channel down on the upper surface of the receiver section of an M-16 rifle, said channel member having a lug with a centrally located aperture, positioned such that the lug is situated on the lowest front edge and parallel to the channel member and extending perpendicular thereto; said channel member having at its forward end, two right angle, vertical tabs which receive the wedge-shaped locking device, which wedge-shaped locking device has a lower edge longer than the top edge and a centrally located threaded set screw in its face for securing the wedge-shaped locking device to the Colt M-16 rifle, said wedge-shaped device having its side edges turned back upon themselves such that the side edges form a lip which is the same width as the vertical tabs on the channel member whereby the wedge-shaped locking device side edges align with and set down over the right angle vertical tabs to help secure the channel member to the colt M-16 rifle.

It is obvious that in actual rifle operation the cover on the side ejection port is removed before the cartridge retriever is fitted thereto.

Figure 2:
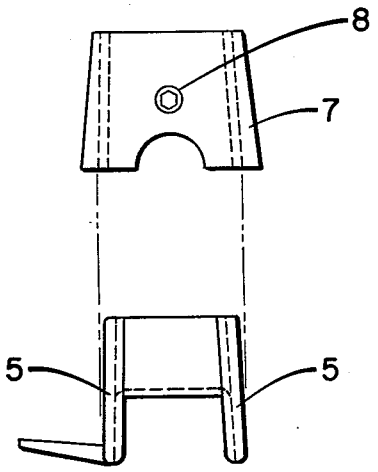

FIG. 2 is an expanded forward end view of the mounting and attaching device wherein the wedge shape of the mounting lock is shown as well as the locking set screw.

Figure 3:
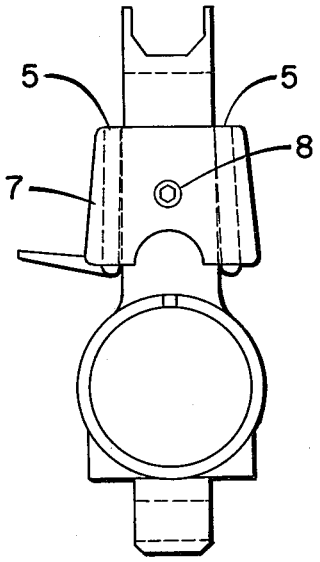

FIG. 3 is a front end view of the inventive mounting and attaching device mounted on the receiver section of an M-16 rifle showing the wedge shaped mounting lock in place over the right angle vertical tabs of the channelled member with the cartridge retriever mounting lug projecting at right angles from the channelled member and tilted slightly upwards.

DESCRIPTION OF THE SPECIFIC EMBODIMENTS

The following description is not to be construed to limit the invention over that which is fairly taught in the claims.

Figure 1:
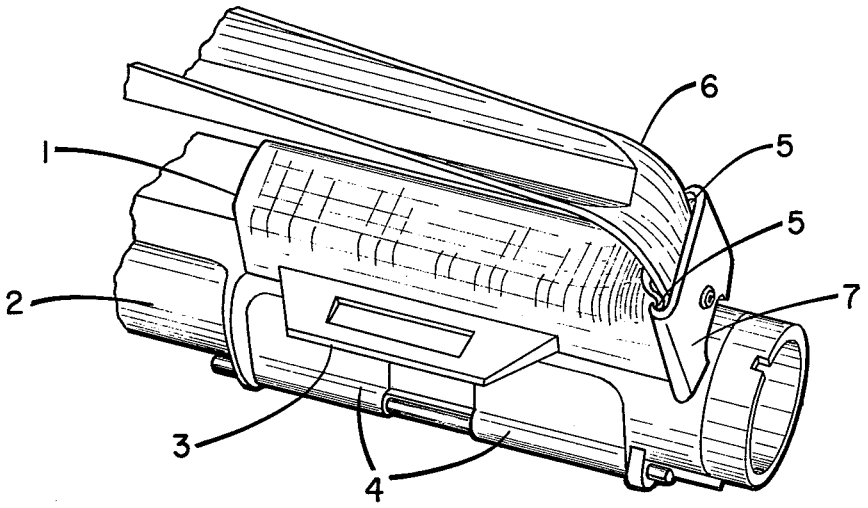
FIG. 1 is a view of a receiver section of an M-16 rifle with the inventive mounting and attaching device shown mounted and attached thereto above the covered ejection port.

As shown in FIG. 1, the invention consists of a rigid channel member 1 which is fitted channel down on the top of the receiver section of an M-16 rifle 2. This channel member is preferably made from metal although tough, abrasion resistant plastics could be used. The channel member is constructed with a projecting lug 3 at the lower edge of the channel member and in parallel therewith such that the lug projects perpendicularly out over the ejection port opening 4 (shown with an ejection port cover in place) the lug is positioned approximately mid-way between the ends of the ejection port opening. The lug does not cover any part of the ejection port owing to its perpendicularity or near perpendicularity to the channel member.

The most forward end of the rigid channel member has two right angle, vertical tapered tabs 5 on which a wedge-shaped locking means can be positioned. These tabs are included in the one-piece construction of the channel member and are therefore firmly attached thereto. The rigid channelled member is flared at its forward end to help form the tabs and the inner surface of the flare is adapted to fit the handle 6 of the M-16 rifle.

Further referring to FIG. 1 and also to FIG. 2, there is provided a rigid wedge-shaped locking device 7 whose bottom edge is slightly longer than it's top edge. The side edges are curled backward in a U-shape such that they will fit snugly down over the tabs 5.

Referring to FIG. 2, the wedge-shaped locking means is shown with a centrally located threaded hole such that it will receive a threaded set-screw 8 or the like. FIG. 3 then shows the locking means in the locking position down over the tabs 5 with the threaded set-screw 8 in position.

When the device is to be used, the channel member is positioned on the top of the housing of the receiver section of the rifle, channel down, and then urged forward in alignment with the handle 6 and then the wedge-shaped locking means is set into place such that the U-shaped edges of the wedge-shaped locking device are set down over the tabs and the set-screw is tightened to secure the device. The lug 3 with slot is now aligned directly over the ejection port and is ready to receive a cartridge retriever. The lug 3 is tapered at its side edges to more readily receive a cartridge retriever. The retriever is affixed with a spring device to engage the tapered lug and lock it thereto but this forms no part of the present invention.

For expedient removal of the mounting and locking means, the set-screw is loosened, the wedge is raised to remove it and the channelled member is taken off by simple lifting.

Obviously, some modifications and variations to the above disclosure can be made without departing from the spirit of the invention.

That which is claimed is:

1. A mounting and attaching device for mounting and attaching a cartridge retriever to an M-16 Colt rifle which comprises in combination a channel member and a wedge-shaped locking device which channel member is a rigid channel member adapted to be mounted channel down on the upper surface of the receiver section of an M-16 rifle, said channel member having a lug with a centrally located aperture, positioned such that the lug is situated on the lowest front edge and parallel to the channel member and extending perpendicular thereto; said channel member having at its forward end, two right angle, vertical tabs which receive the wedge-shaped locking device, which wedge-shaped locking device has a lower edge longer than the top edge and a centrally located threaded set-screw in its face for securing the wedge-shaped locking device to the Colt M-16 rifle, said wedge-shaped device having its side edges turned back upon themselves such that the side edges form a lip which is the same width as the vertical tabs on the channel member whereby the wedge-shaped locking device side edges align with and set down over the right angle vertical tabs to help secure the channel member to the Colt M-16 rifle.

* * * * *